US010234193B2

(12) United States Patent
Gunduz et al.

(10) Patent No.: US 10,234,193 B2
(45) Date of Patent: Mar. 19, 2019

(54) REFRIGERATOR COMPRISING A DRAWER WITH HUMIDITY CONTROL

(71) Applicant: ARCELIK ANONIM SIRKETI, Istanbul (TR)

(72) Inventors: Nihat Gunduz, Istanbul (TR); Feyzi Alper Soysal, Istanbul (TR); Isil Uslu, Istanbul (TR); Serdar Kocaturk, Istanbul (TR); Samet Akan, Istanbul (TR); Levent Akdag, Istanbul (TR)

(73) Assignee: ARCELIK ANONIM SIRKETI, Istanbul (TR)

( * ) Notice: Subject to any disclaimer, the term of this patent is extended or adjusted under 35 U.S.C. 154(b) by 0 days.

(21) Appl. No.: 15/027,237

(22) PCT Filed: Oct. 2, 2014

(86) PCT No.: PCT/TR2014/000353
§ 371 (c)(1),
(2) Date: Apr. 4, 2016

(87) PCT Pub. No.: WO2015/050515
PCT Pub. Date: Apr. 9, 2015

(65) Prior Publication Data

US 2016/0245581 A1 Aug. 25, 2016

(30) Foreign Application Priority Data

Oct. 3, 2013 (TR) ..... a 2013 11629

(51) Int. Cl.
*F25D 25/02* (2006.01)
*F25D 17/04* (2006.01)
(Continued)

(52) U.S. Cl.
CPC ..... *F25D 25/025* (2013.01); *F25D 17/042* (2013.01); *F25D 17/065* (2013.01);
(Continued)

(58) Field of Classification Search
CPC ..... F25D 17/042; F25D 17/065; F25D 21/04; F25D 25/025
(Continued)

(56) References Cited

U.S. PATENT DOCUMENTS 4,013,434 A 3/1977 Kronenberger et al.
4,557,118 A 12/1985 Pink et al.
(Continued)

FOREIGN PATENT DOCUMENTS

CN 1047917 A 12/1990
CN 101131276 A 2/2008
(Continued)

OTHER PUBLICATIONS

International search report for PCT application No. PCT/TR2014/000353.
(Continued)

*Primary Examiner* — James O Hansen
(74) *Attorney, Agent, or Firm* — Kilpatrick Townsend & Stockton LLP

(57) ABSTRACT

The present invention relates to a refrigerator (1) comprising a body (2) wherein foodstuffs and beverages are placed; a protector plate (3) placed into the body (2); at least one drawer (4) that is placed under the protector plate (3), wherein fruits and vegetables are placed; a separator plate (6) that is disposed over the protector plate (3) and that has more than one hole (5) enabling the air delivered to the protector plate (3) to at least partially reach the drawer (4); a shelf (7) that is situated above the protector plate (3) so that there is a distance between the protector plate (6) and the shelf (7); and at least one air blowing opening (122) that is arranged on the body (2) and that enables cold air to be blown.

16 Claims, 3 Drawing Sheets

Figure 1:
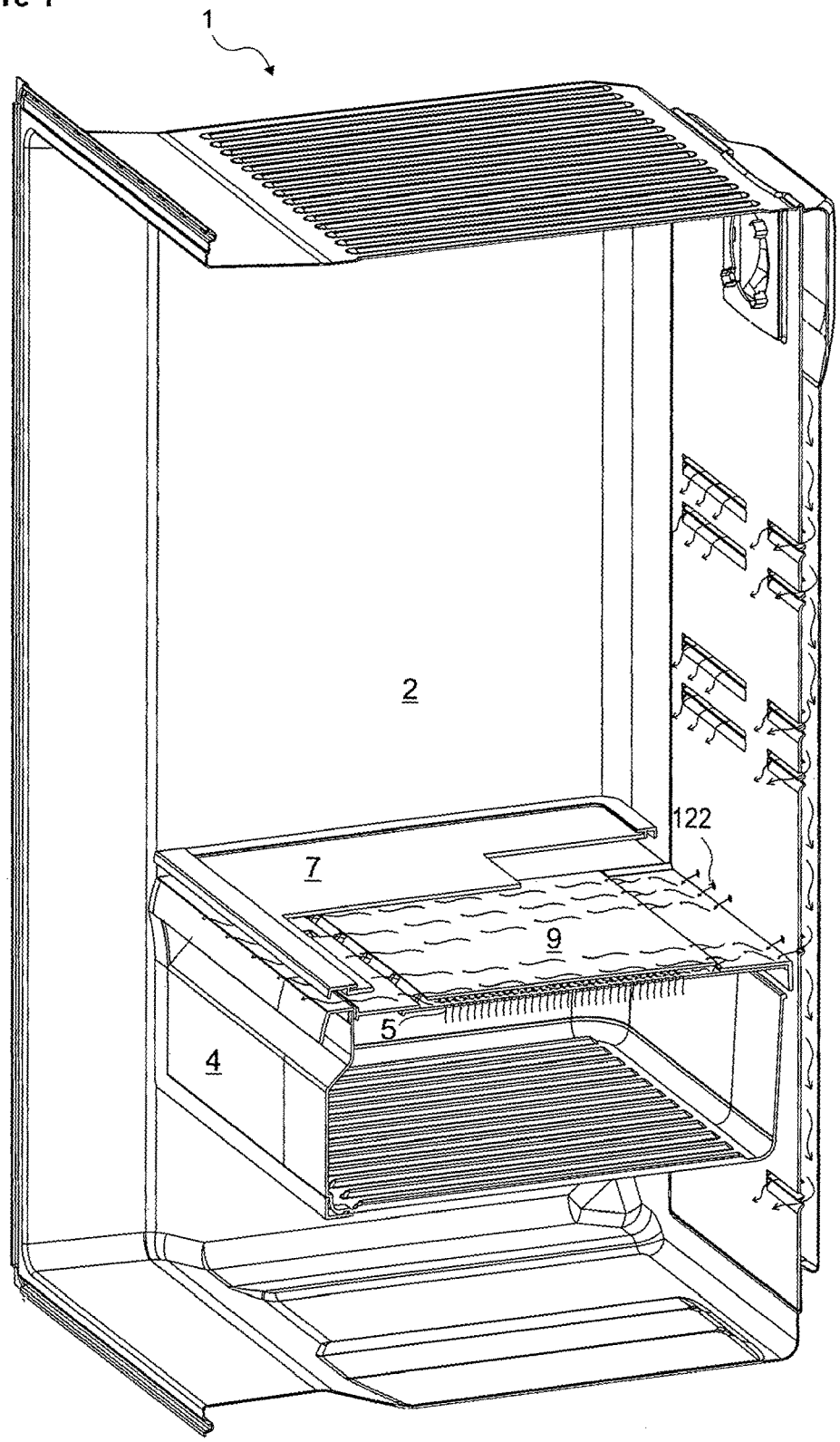

(51) Int. Cl.
*F25D 17/06* (2006.01)
*F25D 21/04* (2006.01)

(52) U.S. Cl.
CPC .... *F25D 21/04* (2013.01); *F25D 2317/04131* (2013.01); *F25D 2317/061* (2013.01); *F25D 2317/063* (2013.01); *F25D 2317/0665* (2013.01); *F25D 2500/02* (2013.01)

(58) Field of Classification Search
USPC ..... 312/401, 404, 408; 62/186, 187, 382, 62/441
See application file for complete search history.

(56) References Cited

U.S. PATENT DOCUMENTS

| | | | | |
|---|---|---|---|---|
| 5,540,492 | A | 7/1996 | Dasher et al. | |
| 6,343,477 | B1 * | 2/2002 | Mandel | F25D 17/042 62/186 |
| 7,159,415 | B2 * | 1/2007 | Wood | B65D 88/126 62/441 |
| 7,856,844 | B2 | 12/2010 | Kim et al. | |
| 8,256,237 | B2 * | 9/2012 | Bischofberger | F25D 17/042 62/186 |
| 2002/0104325 | A1 | 8/2002 | Mandel et al. | |
| 2003/0010056 | A1 * | 1/2003 | Sakamoto | F25D 17/065 62/441 |
| 2010/0319374 | A1 * | 12/2010 | Ihle | F25D 17/045 62/176.1 |
| 2012/0075074 | A1 | 3/2012 | Frosch et al. | |

FOREIGN PATENT DOCUMENTS

| | | | |
|---|---|---|---|
| CN | 101776362 | A | 7/2010 |
| EP | 0719994 | A1 | 7/1996 |
| EP | 1936302 | A1 | 6/2008 |
| JP | S63113886 | U | 7/1988 |
| JP | H02306083 | A | 12/1990 |
| JP | H09113124 | A | 5/1997 |
| JP | 2001330359 | A | 11/2001 |
| KR | 20010001298 | A | 1/2001 |
| KR | 20040048776 | A | 6/2004 |
| WO | WO 01/71263 | * | 9/2001 |
| WO | 2004038312 | A1 | 5/2004 |
| WO | 2009083388 | A2 | 7/2009 |
| WO | 2010029041 | A1 | 3/2010 |

OTHER PUBLICATIONS

Written opinion of the international searching authority for PCT application No. PCT/TR2014/000353.

* cited by examiner

REFRIGERATOR COMPRISING A DRAWER WITH HUMIDITY CONTROL

The present invention relates to a refrigerator that comprises a drawer wherein humidity control is performed.

Refrigerators comprise a fresh food compartment wherein foods and beverages are stored, a freezer compartment that enables foods to be stored by being frozen, and a crisper that is disposed in the fresh food compartment, wherein foods such as vegetables and fruits are stored. In order to prevent the foods placed in the crisper from dehydrating by sweating, the air flow into the crisper volume is enabled to remain at a limited level. Thus, humidity loss of vegetables and fruits is decreased to minimum by providing high humidity rates (~90% RH) in the crisper. However, in high humidity conditions, the risk of condensation on surfaces below the dew point temperature in the crisper arises. The condensation occurring on the surfaces of the crisper results in dripping of water on the foods stored in the crisper and this causes the foods to spoil by adversely affecting storage lives of the foods. Moreover, in order to minimize the humidity loss of the vegetables, it is required that the temperature difference between the base and ceiling surfaces of the crisper is as low as possible and mass transfer by natural convection is minimized.

Various methods are developed in the technique in order to prevent the formation of water drops by regulating the humidity balance of the crisper and to provide air movement in the crisper.

In the state of the art International Patent Application No. WO2004038312, a cooling air supply unit introducing air into the vegetable box, a plurality of cooling air ventilating holes situated on the vegetable box cover and the valves therein are described.

In the state of the art Japanese Patent Application No. JP9113124, a refrigerator is explained that has a vegetable storage container wherein moisture control is performed by controlling the air intake and exit.

In the state of the art Chinese Patent Application No CN101131276, a drawer type storage chamber is explained, the moisture balance of which is adjusted by the air intake and exit being controlled and by enabling the air to flow over the outer surface of the drawer type storage chamber or through it.

The aim of the present invention is the realization of a refrigerator wherein the amount of humidity in the drawer is controlled.

Another aim of the present invention is to prevent the formation of condensation on the inner surface of the drawer cover without increasing humidity loss of the vegetables thanks to the controlled air intake and discharge. Moreover, it is aimed to create an air flow that enables the temperature difference between the base and the ceiling to remain below 1° C. so as to minimize the humidity loss of the vegetables.

The refrigerator realized in order to attain the aim of the present invention, explicated in the first claim and the respective claims thereof, comprises a separator plate that has more than one hole almost any region thereon, enabling the air delivered to the protector plate to reach the drawer, a shelf that is situated above the protector plate in the refrigerator so that a gap remains between the protector plate and the shelf, and an air blowing opening that is arranged on the body, that remains between the protector plate and the shelf and that has an inclined configuration allowing air blowing onto the protector plate. The refrigerator furthermore, comprises a ceiling having at least one inlet port that enables the air, that is blown through the air blowing opening and that rises after hitting the portion of the protector plate remaining between the body rear wall and the inlet port, to be delivered partially to the separator plate and partially to between the protector plate and the shelf while still rising.

In an embodiment of the present invention, the inlet port extends with an inclination almost parallel to the rising direction of the air that hits the separator plate and rises.

In an embodiment of the present invention, the refrigerator has the cross-sectional area that is wider than the cross-sectional areas of more than one air blowing opening and that remains between the separator plate and the ceiling.

In an embodiment of the present invention, the ceiling has more than one inlet port, each situated opposite to one air blowing opening, and more than one outlet port, each facing one inlet port.

In an embodiment of the present invention, the outlet port has a wider cross-section than the inlet port.

In an embodiment of the present invention, the ceiling has the outlet ports with a distance therebetween larger than the distance between two inlet ports.

In an embodiment of the present invention, the separator plate and the ceiling are situated almost opposite to the air blowing openings.

In an embodiment of the present invention, the separator plate and the ceiling are disposed almost at the center of the drawer.

In an embodiment of the present invention, the ratio of the total cross-sectional area of the inlet ports to the total cross-sectional area of the holes is a ratio between 1:10 and 1:5.

In an embodiment of the present invention, the ratio of the total cross-sectional area of the outlet ports to the total cross-sectional area of the holes is a ratio between 1:3 and 1:5.

In an embodiment of the present invention, the refrigerator comprises two ribs that are situated on the protector plate, that extend from the ceiling with a distance therebetween and almost at the center of which the air blowing opening remains when the drawer is placed into the refrigerator.

By means of the present invention, condensation is prevented from occurring on the surfaces of the drawer, and foods stored in the drawer are prevented from being spoiled due to water dripping thereon, hence the storage lives of foods in the drawer are enabled to be increased.

A refrigerator realized in order to attain the aim of the present invention is illustrated in the attached figures, where:

FIG. 1—is the cross-sectional schematic view of the refrigerator in an embodiment of the present invention.

Figure 2:
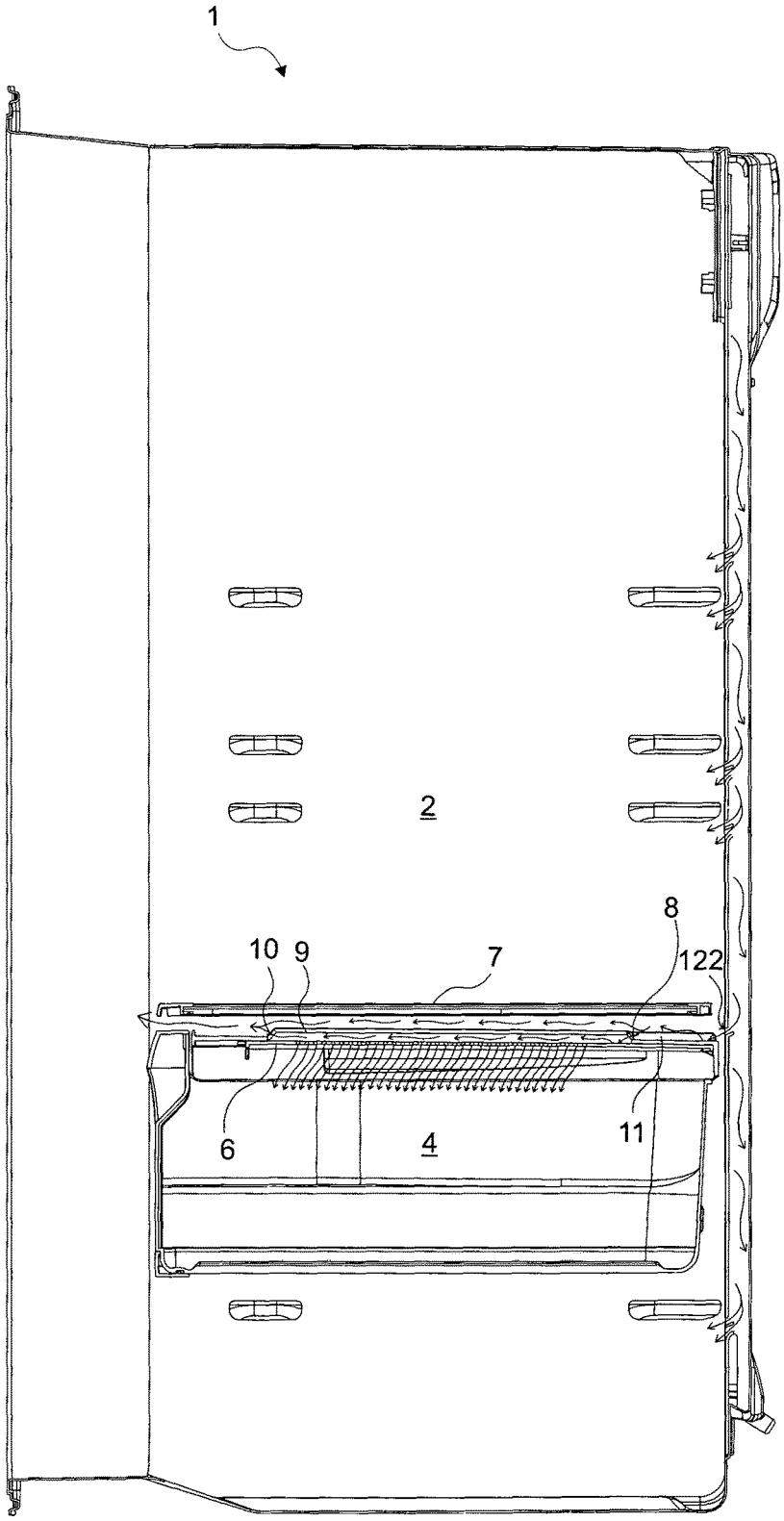

FIG. 2—is the sideways cross-sectional schematic view of the refrigerator in an embodiment of the present invention.

Figure 3:
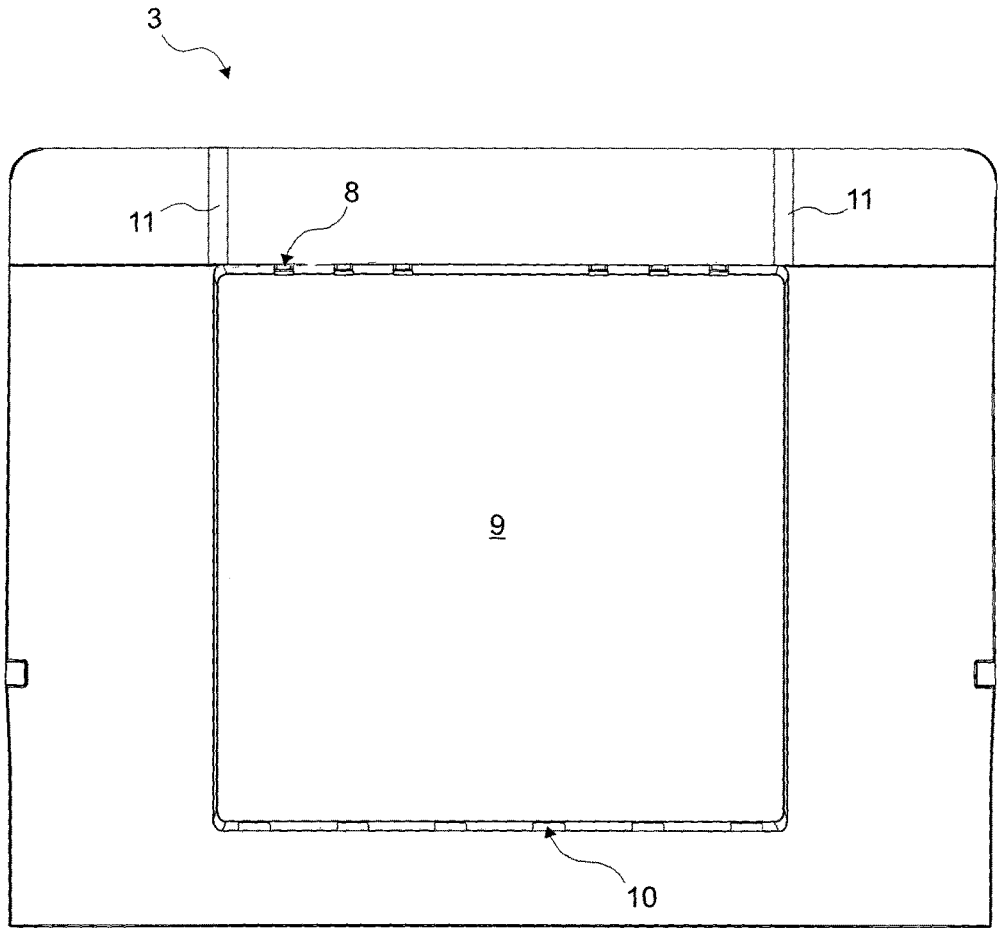

FIG. 3—is the top view of the protector plate in an embodiment of the present invention.

The elements illustrated in the figures are numbered as follows:

1. Refrigerator
2. Body
3. Protector plate
4. Drawer
5. Hole
6. Separator plate
7. Shelf
8. Inlet port
9. Ceiling
10. Outlet port

11. Rib

122. Air blowing opening

The refrigerator (1) comprises a body (2) wherein foodstuffs and beverages are placed; a protector plate (3) placed into the body (2); at least one drawer (4) that is placed under the protector plate (3), wherein fruits and vegetables are placed; a separator plate (6) that is disposed over the protector plate (3) and that has more than one hole (5) enabling the air delivered to the protector plate (3) to at least partially reach the drawer (4); a shelf (7) that is situated above the protector plate (3) so that there is a distance between the protector plate (3) and the shelf (7); and at least one air blowing opening (122) that is arranged on the body (2) and that enables cold air to be blown (FIG. 1).

The refrigerator (1) furthermore comprises a ceiling (9) that is disposed on the protector plate (3) so that a distance remains between the separator plate (6) and the ceiling (9), that covers the upper side of the separator plate (6), that extends from over the protector plate (3) and that has at least one inlet port (8) that enables the air blown through the air blowing opening (122) to be partially delivered to the separator plate (6) and to be partially distributed between the shelf (7) and the protector plate (3), and the air blowing opening (122) that remains almost between the protector plate (3) and the shelf (7), that faces between the protector plate (3) and the shelf (7) and that blows the air in an inclined manner to between the inlet port (8) and the body (2) so as to contact the upper side of the protector plate (3)

(FIG. 1, FIG. 2, FIG. 3).

While the air blown in an inclined manner through the air blowing opening (122) so as to hit the flat surface of the protector plate (3) rises after hitting the surface of the protector plate (3), the air partially enters the protector plate (3) through the inlet ports (8) and is partially distributed between the protector plate (3) and the shelf (7) that remains above the protector plate (3) and has a distance between the protector plate (3) and itself. Thus, formation of condensation is prevented on the lower surface of the shelf (7) and the air is delivered into the drawer (4) in an amount and at a flow rate preferred by the producer. The air passing through the inlet port (8) passes through the holes (5) arranged on the separator plate (6) and reaches the interior of the drawer (4).

In an embodiment of the present invention, the ceiling (9) comprises at least one outlet port (10) that is almost opposite to the inlet port (8). A distance is provided between the ceiling (9) and the separator plate (6). The air entering between the separator plate (6) and the ceiling (9) via the inlet port (8) partially reaches the drawer (4) by means of the holes (5) while reaching the outside of the separator plate (3) by means of the outlet ports (10). By means of the air delivered to the drawer (4) in a controlled manner, formation of condensation is prevented on the surface of the protector plate (3) while vegetables and fruits are enabled to be stored at relative humidity rates of approximately 90% RH which are ideal storage conditions. Moreover, a certain distance is also provided between the ceiling (9) and the shelf (7) that is disposed above the ceiling (9). Thus, the air blown through the air blowing opening (122) is partially distributed between the ceiling (9) and the shelf (7). Consequently, the temperature of the ceiling (9) can be cooled to a certain degree in order to minimize the temperature difference between the separator plate (6) and the ceiling (9).

In an embodiment of the present invention, the ceiling (9) has the inlet port (8) with an inclination almost perpendicular to the exit direction of the air blown through the air blowing opening (122). The inlet port (8), that extends in a direction parallel to the rising direction of the air blown through air blowing opening (122) and rising after hitting the protector plate (3), enables the said air to be partially delivered to the separator plate (6) and partially delivered to between the ceiling (9) and the shelf (7).

In an embodiment of the present invention, the cross-sectional area of the flow path remaining between the separator plate (6) and the ceiling (9) is wider than the cross-sectional area of the air blowing opening (122). Since the cross-sectional area between the inlet port (8) and the outlet port (10) is wider than the cross-sectional area of the air blowing opening (122), the air can be easily dispersed between the separator plate (6) and the ceiling (9).

In an embodiment of the present invention, the ceiling (9) has more than one inlet port (8), each situated opposite to one air blowing opening (122), and more than one outlet port (10), each facing one inlet port (8).

In an embodiment of the present invention, the outlet port (10) has a wider, cross-section than the inlet port (8). Thus, the air is homogeneously distributed between the separator plate (6) and the ceiling (9) and condensation is prevented on every part of the separator plate (6) surface by controlling the amount of air entering the drawer (4) through the holes (5) and without increasing the humidity loss of the vegetables.

In an embodiment of the present invention, the ceiling (9) has the outlet ports (10) with a distance therebetween larger than the distance between two inlet ports (8).

In an embodiment of the present invention, the separator plate (6) and the ceiling (9) are disposed almost at the center of the protector plate (3). Thus, condensation is prevented at the middle portion of the protector plate (3) which is the region where condensation is observed most.

In an embodiment of the present invention, the ratio of the total cross-sectional area of the inlet ports (8) to the total cross-sectional area of the holes (5) is a ratio between 1:10 and 1:5. Thus, the ideal temperature and relative humidity ratio enabling vegetables to be stored in the drawer (4) are provided and condensation is prevented on the surfaces thereof without increasing the humidity loss of the vegetables.

In an embodiment of the present invention, the ratio of the total cross-sectional area of the outlet ports (10) to the total cross-sectional area of the holes (5) is a ratio between 1:3 and 1:5. Thus, the ideal temperature and relative humidity ratio enabling vegetables to be stored in the drawer (4) are provided and condensation is prevented on the surfaces thereof without increasing the humidity loss of the vegetables.

In an embodiment of the present invention, the refrigerator (1) comprises two ribs (11) that are situated on the protector plate (3), that extend from the ceiling (9) with a distance therebetween and almost at the center of which the air blowing opening (122) remains when the drawer (4) is placed into the refrigerator (1). The ribs (11) help the air blown through the air blowing opening (122) to be directed towards the inlet ports (8) and enables the air to remain between the two ribs (11) although partially.

By means of the refrigerator (1) of the present invention, the humidity of the drawer (4) is effectively controlled. Formation of condensation on the surfaces of the protector plate (3) and the drawer (4) is prevented.

The invention claimed is:

1. A refrigerator (1) comprising:

a body (2) wherein foodstuffs and beverages are placed;

a protector plate (3) placed into the body (2), wherein the protector plate comprises a separator plate (6) and a ceiling (9) situated above and parallel to the separator plate (6), such that the ceiling (9) and the separator plate (6) are evenly separated by a first space of uniform distance between the ceiling (9) and the separator plate (6), wherein the ceiling includes a continuous surface, wherein the ceiling (9) and the separator plate (6) are physically coupled through a first inclined surface at a first end of the ceiling (9) and a second inclined surface at a second end of the ceiling (9) opposite from the first end;

at least one drawer (4) that is placed under the protector plate (3), wherein fruits and vegetables are placed; wherein the separator plate (6) has more than one hole (5) enabling the air delivered to the first space of the protector plate (3) to at least partially reach the at least one drawer (4);

a shelf (7) that is situated above and parallel to the ceiling (9) of the protector plate (3) so that the ceiling (9) and the shelf (7) are evenly separated by a second space between the protector plate (3) and the shelf (7); and an air blowing opening (122) that is arranged on the body (2) and that enables cold air to be blown, wherein the first inclined surface has at least one inlet port (8) with an inclination almost perpendicular to an exit direction of the air blowing opening (122) that enables the air blown through the air blowing opening (122) to be partially delivered to the separator plate (6) and to be partially distributed to the second space between the shelf (7) and the protector plate (3), and wherein the air blowing opening (122) is between the protector plate (3) and the shelf (7) facing the second space between the protector plate (3) and the shelf (7) and that blows the air in an inclined manner to between the inlet port (8) and the body (2) at an angle such that the blown air bounces off the protector plate (3) in a direction parallel to the inclination of the at least one inlet port (8).

2. The refrigerator (1) as in claim 1, wherein the second inclined surface has at least one outlet port (10) that is situated almost opposite to the at least one inlet port (8).

3. The refrigerator (1) as in claim 2, wherein the cross-sectional area of the flow path of the first space remaining between the separator plate (6) and the ceiling (9) is wider than the cross-sectional area of the air blowing opening (122).

4. The refrigerator (1) as in claim 2, wherein the outlet port (10) has a cross-section wider than that of the inlet port (8).

5. The refrigerator (1) as in claim 2, further comprising more than one inlet port (8), each situated opposite to one air blowing opening (122), and more than one outlet port (10), each facing one inlet port (8).

6. The refrigerator (1) as in claim 2, wherein the at least one outlet port (10) includes two outlet ports, wherein the at least one inlet port includes two inlet ports, and wherein a distance between the two outlet ports is larger than a distance between the two inlet ports (8).

7. The refrigerator (1) as in claim 2, wherein the separator plate (6) and the ceiling (9) are situated almost at the center of the protector plate (3).

8. The refrigerator (1) as in claim 2, wherein the ratio of the total cross-sectional area of the at least one inlet port (8) to the total cross-sectional area of the holes (5) is between 1:10 and 1:5.

9. The refrigerator (1) as in claim 2, wherein the ratio of the total cross-sectional area of the at least one outlet port (10) to the total cross-sectional area of the holes (5) is between 1:3 and 1:5.

10. The refrigerator (1) as in claim 2, further comprising two ribs (11) that are situated on the protector plate (3), that extend from the ceiling (9) with a distance therebetween and almost at the center of which the air blowing opening (122) remains when the drawer (4) is placed into the refrigerator (1).

11. The refrigerator (1) as in claim 1, wherein the cross-sectional area of the flow path of the first space remaining between the separator plate (6) and the ceiling (9) is wider than the cross-sectional area of the air blowing opening (122).

12. The refrigerator (1) as in claim 1, further comprising two ribs (11) that are situated on the protector plate (3), that extend from the ceiling (9) with a distance therebetween and almost at the center of which the air blowing opening (122) remains when the drawer (4) is placed into the refrigerator (1).

13. The refrigerator (1) as in claim 1, wherein the first space has a uniform thickness and extends along a full length of the ceiling (9), and wherein the second space extends along a full length of the shelf (7).

14. The refrigerator (1) as in claim 1, wherein the first inclined surface has a negative slope, and the second inclined surface has a positive slope.

15. The refrigerator (1) as in claim 1, wherein the first inclined surface and the second inclined surface have opposite slopes.

16. A refrigerator (1) comprising:

a body (2) wherein foodstuffs and beverages are placed;

a protector plate (3) placed into the body (2), wherein the protector plate comprises a separator plate (6) and a ceiling (9) situated above and parallel to the separator plate (6), such that the ceiling (9) and the separator plate (6) are evenly separated by a first space of uniform distance between the ceiling (9) and the separator plate (6), wherein the ceiling includes a continuous surface, wherein the ceiling (9) and the separator plate (6) are physically coupled through a first inclined surface at a first end of the ceiling (9) and a second inclined surface at a second end of the ceiling (9) opposite from the first end;

at least one drawer (4) that is placed under the protector plate (3), wherein fruits and vegetables are placed; wherein the separator plate (6) has more than one hole (5) enabling the air delivered to the first space of the protector plate (3) to at least partially reach the at least one drawer (4);

a shelf (7) that is situated above and parallel to the ceiling (9) of the protector plate (3) so that the ceiling (9) and the shelf (7) are evenly separated by a second space between the protector plate (3) and the shelf (7); and an air blowing opening (122) that is arranged on the body (2), wherein the first inclined surface has at least one inlet port (8) and the second inclined surface has at least one outlet port (10), and wherein the air blowing opening (122) enables cold air to be partially delivered to the at least one inlet port (8) and to be partially delivered to the second space between the shelf (7) and the protector plate (3).

* * * * *